United States Patent [19]

Fallows

[11] 4,270,396

[45] Jun. 2, 1981

[54] VIBRATOR

[75] Inventor: John Fallows, Little Rock, Ark.

[73] Assignee: Global Manufacturing, Inc., Little Rock, Ark.

[21] Appl. No.: 41,638

[22] Filed: May 23, 1979

[51] Int. Cl.[3] ..... B06B 1/16

[52] U.S. Cl. ..... 74/87; 366/128

[58] Field of Search ..... 74/87; 209/366.5; 366/128; 404/113, 114, 115, 116, 117

[56] References Cited

U.S. PATENT DOCUMENTS

| | | | |
|---|---|---|---|
| 1,858,855 | 5/1932 | Haas | 74/87 X |
| 3,266,739 | 8/1966 | McKibben | 74/87 X |
| 3,721,129 | 3/1973 | Wallick | 74/87 |
| 3,922,043 | 11/1975 | Tompkins et al. | 74/87 X |
| 4,113,403 | 9/1978 | Tertinek et al. | 404/113 |

FOREIGN PATENT DOCUMENTS

| | | | |
|---|---|---|---|
| 703779 | 2/1965 | Canada | 74/87 |

*Primary Examiner*—Allan D. Herrmann

*Attorney, Agent, or Firm*—Brumbaugh, Graves, Donohue & Raymond

[57] ABSTRACT

A rotary vibrator having a housing, a rotating shaft, and one or more eccentric weights having a hub portion mounted on the shaft and an eccentric portion extending outwardly from the hub generally perpendicular to the rotational axis. Each eccentric portion is defined by leading and trailing edges extending generally radially from the hub and connected to an outer periphery. Air inlet and outlet passages are arranged longitudinally in the housing at each end thereof for the purpose of admitting and circulating air in and around the bearings of the vibrator. The faces of the leading edges of the eccentric weights are beveled toward the outlet passages in a manner so that upon rotation of the vibrator, the leading edges will act like a propeller to draw air in through the inlet passages, circulate it through the housing and push it out through the outlet passages, thereby to ventilate and cool the vibrator bearings.

8 Claims, 4 Drawing Figures

VIBRATOR

BACKGROUND OF THE INVENTION

This invention relates generally to an improved vibrating machine, and particularly to a rotary eccentric weight vibrator using bearings sealed within the housing and having improved forced ventilation and cooling characteristics for longer service life of the bearings.

Eccentric vibrators customarily have one or more eccentric weights rotatably mounted on a shaft in the vibrator housing, which shaft is driven externally such as by a pneumatic or hydraulic motor. The shaft bearings, since they have to carry not only the mass of the rotating eccentric weights, but the cyclical vibrational forces as the weight spins, present a problem in terms of breakdown and wear. Proper lubrication and cooling of the bearings is essential to avoid premature failure.

Sealed, grease lubricated bearings have been used in the past in vibrators. The poor heat transfer characteristics inherent in sealed bearings have, however, tended to limit the load bearing capabilities, operational speeds, and endurance of this type of vibrator. Under heavy or extended loading, or high rotational velocity, causing heat buildup in the bearings, the lubricant tends to break down, causing the bearings to score, freeze up, or otherwise fail.

An improved vibrator of this general type using sealed, oil lubricated bearings, is described in commonly owned U.S. Pat. No. 3,922,043. In the device disclosed therein, output air from the pneumatic motor is directed into the vibrator housing and used to cool the sealed bearings, and thus substantially improve the service life of the vibrator.

SUMMARY OF THE INVENTION

The present invention is an improved vibrator of the type which incorporates sealed, oil lubricated bearings, and has improved self-cooling and ventilation properties to further increase the service life and load bearing capabilities of the sealed bearings. The vibrator may be pneumatically driven, but in view of the inherent self-cooling characteristics, the vibrator may instead incorporate a hydraulic or electric motor drive, or even a pulley with belts, without the need for auxiliary cooling of the housing, provided, for example, by the pneumatic motor output air.

More particularly, the present invention is a rotary vibrator having a housing, a shaft in the housing rotatable about its longitudinal axis, and one or more eccentric weights mounted on the shaft. Each weight has a hub portion, which is mounted on the shaft, and an eccentric portion flaring outwardly from the hub portion generally in a plane perpendicular to the shaft rotational axis. The eccentric portion of each of the weights is designed to have radially extending leading and trailing edges connected to the outer periphery.

The vibrator housing is provided with air inlet passages and air outlet passages to provide a flow through of air. Preferably, the inlet and outlet passages are arranged longitudinally at opposite ends of the vibrator housing. In the case of a pneumatically driven vibrator, the air inlet may be the outlet from the pneumatic motor. The face of each of the leading edges of the weights, and optionally the trailing edges of the weights (where reversibility is desirable) is beveled toward the outlet passages, so that as the weights rotate on their axis they will act to draw air in from the inlet passages, and circulate air through the entire housing around the bearings and toward the outlet passages.

BRIEF DESCRIPTION OF THE DRAWINGS

For a better understanding of the invention, reference may be had to the following detailed description of the preferred embodiments, taken in conjunction with the accompanying drawings, in which.

DESCRIPTION OF THE PREFERRED EMBODIMENTS

Figure 3:
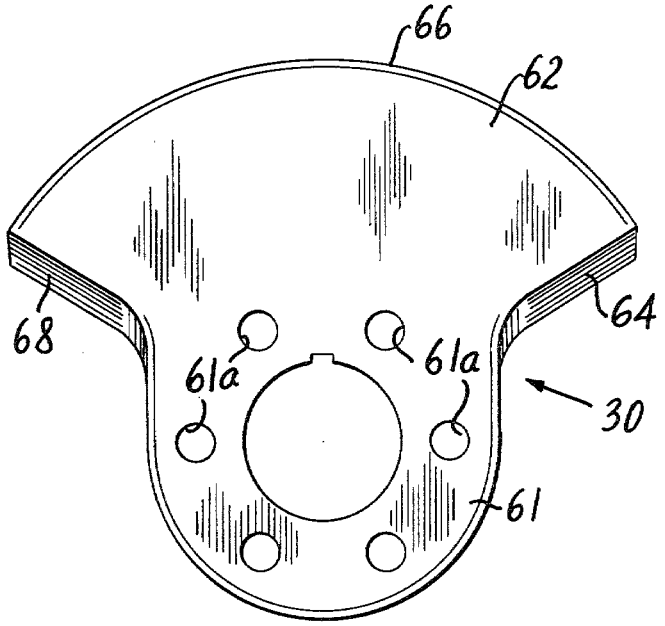
FIG. 3 is a front plan view of an eccentric weight for use in a vibrator in accordance with the present invention.

Referring to the drawings, an eccentric weight vibrator 10 according to the present invention has a ductile iron housing 12 provided with a mount in the form of, for example, a six-bolt, bolt-on base 14. Alternatively, the mount may be of the clamp-on type. A motor 16 either of the hydraulic type as shown in FIGS. 1 and 3, or the pneumatic type illustrated in FIG. 4 and designated as 16', is secured to the housing 12 for driving the vibrator 10 in a manner to be described below.

The housing 12 includes a web 20 provided with an opening 21 in which are arranged a pair of spherical, sealed, oil lubricated roller bearings 22 and 24. A splined shaft 18 is coupled by means described hereinafter to the shaft (not shown) of the motor 16, and is rotatably mounted in the housing assembly 12 on the bearings 22 and 24. A similar configuration is described in greater detail in U.S. Pat. No. 3,922,043, which is incorporated herein by reference.

Figure 2:
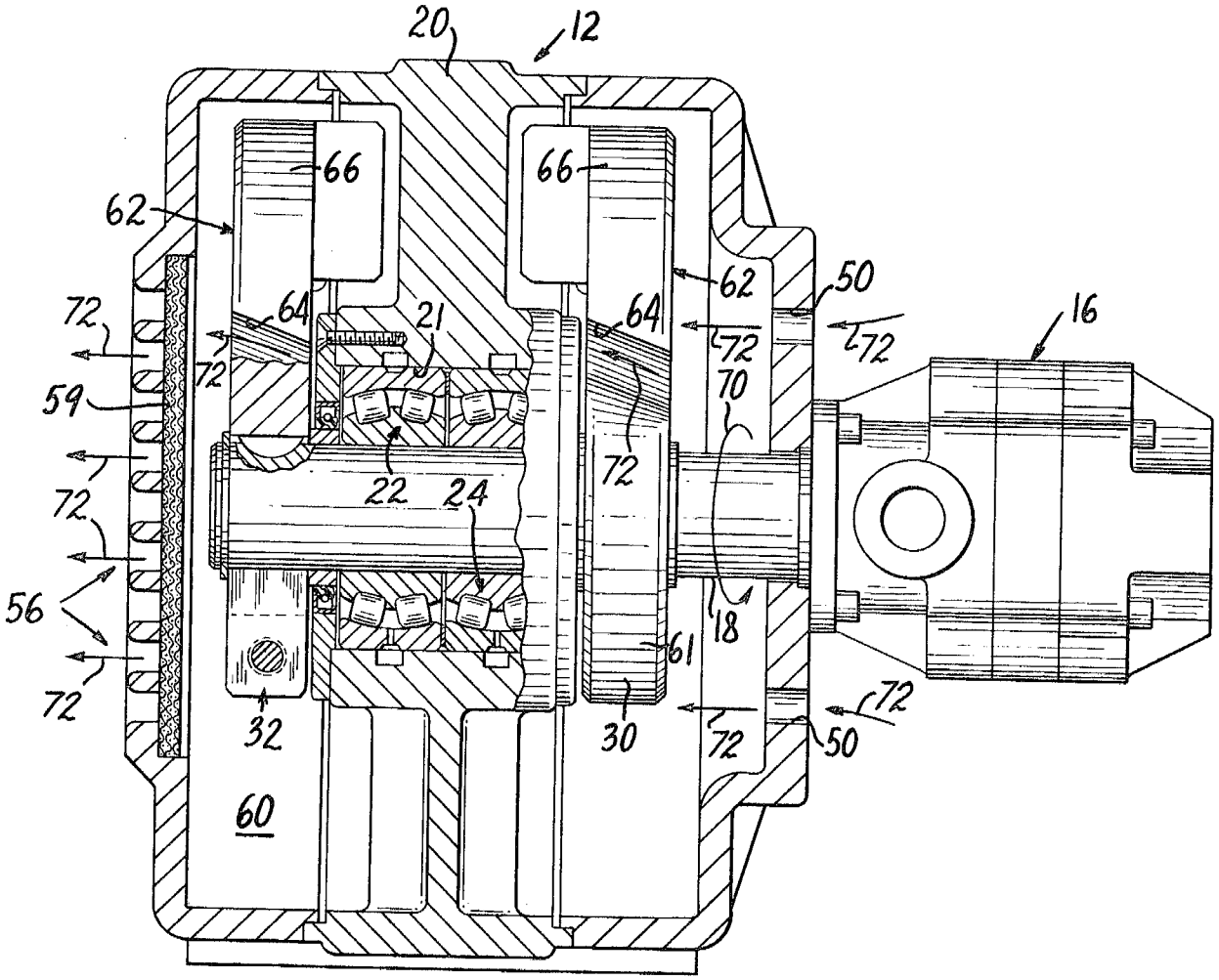
FIG. 2 is a longitudinal sectional side view showing the vibrator of FIG. 1.
Figure 4:
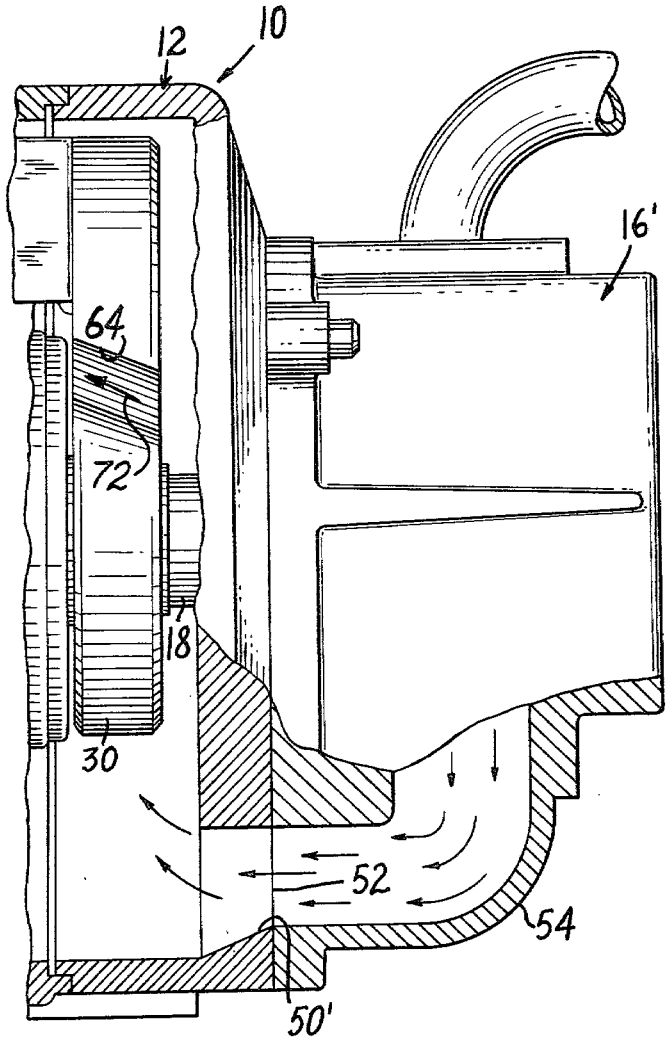
FIG. 4 is a partial longitudinal sectional view of a pneumatically driven vibrator according to the present invention.

A pair of eccentrically mounted weights 30 and 32 are mounted on shaft 18 for rotation therewith. As shown in FIGS. 2 and 4, the eccentric weights 30 and 32 may be advantageously arranged to bracket web 20 and bearings 22 and 24. Rotation of the eccentrics 30, 32 results in vibrations in a conventional manner.

Figure 1:
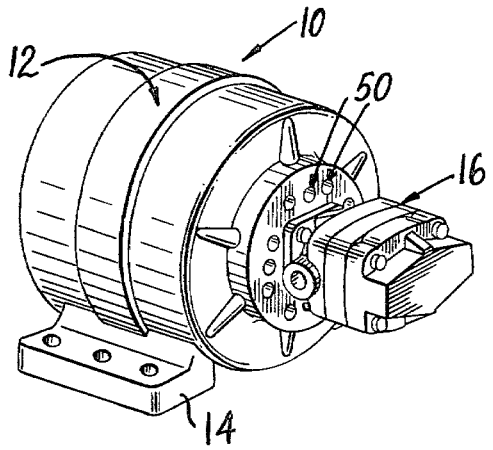
FIG. 1 is a perspective view showing a hydraulically driven eccentric weight vibrator in accordance with the present invention.

The housing assembly 12 is provided with air inlet passages, denominated by the number 50 in the case of the hydraulic driven vibrator shown in FIGS. 1 and 2, and denominated by the number 50' in the case of the pneumatically driven vibrator of FIG. 4. In the case of the pneumatically driven vibrator, the inlet port 50' is connected with the outlet port 52 of the outlet duct 54 of the pneumatic motor 16'. Optionally, additional air inlet passages may be provided in the housing.

In either a pneumatically or hydraulically driven vibrator, outlet passages 56 are provided at the end of the housing 12' opposite the inlet passages 50 or 50' to be arranged longitudinally with respect thereto. As shown in FIG. 2, the outlet ports 56 may be formed by a plurality of longitudinal members forming a grille which partially retains a filter 59 constructed from expanded aluminum or the like. This is particularly desirable where a pneumatic motor is used, since the housing assembly 12 forms a case which acts as an expansion chamber 60 for expanding the air received from the inlet port 52, and thus will substantially reduce the output noise level, as described more fully in U.S. Pat. No. 3,922,043.

The eccentric weights 30 and 32 used in the vibrator 10 have a hub portion 61 which is mounted on the shaft 18 for rotation therewith. The hub portion 61 of weight 30 also has formed thereon a plurality of spacial through-holes 61a. The through-holes receive rods (not shown) which couple the weight directly to a coupling in the form of a disc (also not shown). The shaft of the motor couples into the disc which, in turn, is coupled directly to the weight 30. The direct drive feature has been incorporated in the rotary eccentric weight vibrator made by the assignee of this application since about 1976. The details thus form no part of this invention, are part of the state of the art, and need not be discussed herein with great particularity.

The eccentric portion 62 of each weight flares outwardly from the hub portion 61 generally in a plane perpendicular to the rotational axis of the shaft 18. Each eccentric portion 62 is formed to have a leading edge 64 and a trailing edge 68 in the direction of rotation illustrated in FIG. 2 extending generally radially with respect to the shaft axis of rotation, and connected to an outer periphery 66 of the weight 30. As can be seen most clearly in FIG. 2, the face of the leading edge 64 is beveled toward the outlet openings 56, and optionally the trailing edges 68 may be beveled in a similar manner, for the reasons set forth below.

For the purpose of illustrating the operation of the device, it is assumed that the coupled shaft 18 and the eccentric weight 32 are driven to rotate in the direction indicated by the arrow 70 by the eccentric weight 30, which is coupled directly to the shaft of the motor. As the weights 30 and 32 rotate, the beveled faces of the leading edges 64 will act in a manner similar to a propeller and draw air in through the inlet openings 50, and force the air through the vibrator toward the outlet openings, the direction of air flow being indicated by the arrows 72. In the case of a pneumatically driven vibrator, the edges 64 will act to assist in drawing air in from the outlet 52 of the pneumatic motor 16'. In either case, however, the leading edges 64 will circulate the drawn-in air up through the entire vibrator housing 12, circulating it around the bearings 22, 24 and provide uniform forced cooling of the sealed bearings.

In the case where the faces of the trailing edges 68 of the eccentric weights 30 and 32 are likewise beveled toward the outlet passages 56, the direction of the vibrator may be periodically reversed as desired without affecting the operation of the ventilating and cooling design.

Thus, in accordance with the present invention, a hydraulically driven vibrator may be practicably constructed and operated with sealed, oil lubricated bearings, without the benefit of a pneumatic motor air exhaust to help cool the bearings. The provision of air inlet 50 and outlet 56 openings in the housing, together with the beveled edge design of the eccentric weights, will cause sufficient air to be drawn into the housing and be circulated efficiently to provide the necessary cooling for the sealed bearings, and permit stable operation.

Alternatively, when used in conjunction with a pneumatic motor 16', the exhaust air from the motor will be drawn into the vibrator and more effectively and uniformly circulated in and around the bearings 22, 24, to improve the necessary cooling at all points of the sealed bearing housings and prevent over-heating.

Although the invention has been shown and described with reference to particular embodiments thereof, it will be understood that variations and modifications will be apparent to those skilled in the art, while not departing from the inventive concept disclosed herein. All such variations and modifications are intended to be within the scope of the present invention, as defined in the following claims.

I claim:

1. A rotary vibrator comprising a housing, a shaft mounted on bearing means in said housing and rotatable about its longitudinal axis, means for rotating said shaft about said axis, at least one eccentric weight in said housing, each said eccentric weight having a hub portion mounted on said shaft for rotation therewith and an eccentric portion extending outwardly from said hub portion generally in a plane perpendicular to said axis, each said eccentric portion having a leading edge extending generally radially with respect to said axis, air inlet and outlet passages in said housing, and means on said leading edges for forcing air axially through said housing upon rotation of said eccentric weight for drawing air in through said air inlet passages and pushing said air out through said outlet passages thereby to ventilate and cool the vibrator bearing means.

2. A vibrator according to claim 1, wherein the face of each said leading edge is beveled toward said outlet passages.

3. A vibrator according to claim 2, wherein said inlet and outlet passages are axially arranged with respect to said shaft.

4. A vibrator according to claim 3, wherein said means for rotating said shaft comprises a hydraulic motor.

5. A vibrator according to claim 3, wherein said means for rotating said shaft comprise a pneumatic motor, and said inlet passages communicate with the outlet air of said motor.

6. A vibrator according to claim 3, wherein each said eccentric portion is defined by said leading edge, a trailing edge extending generally radially with respect to said axis, and an outer periphery, said leading and trailing edges connected to said outer periphery of said eccentric portion, and wherein the face of each said trailing edge is beveled toward said outlet passages thereby to make said vibrator reversible.

7. A vibrator according to claim 1, 2, 3, 4, 5, or 6, wherein said bearing means comprise sealed bearings.

8. A vibrator according to claim 7, wherein the bearings are oil lubricated.

* * * * *